US006832950B2

(12) United States Patent
Wright et al.

(10) Patent No.: US 6,832,950 B2
(45) Date of Patent: Dec. 21, 2004

(54) POLISHING PAD WITH WINDOW

(75) Inventors: Jason R. Wright, Sunnyvale, CA (US); Andreas Norbert Wiswesser, Mountain View, CA (US); Boguslaw A. Swedek, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 40 days.

(21) Appl. No.: 10/282,730

(22) Filed: Oct. 28, 2002

(65) Prior Publication Data

US 2004/0082287 A1 Apr. 29, 2004

(51) Int. Cl.[7] ..... B24D 17/00

(52) U.S. Cl. ..... 451/490; 451/5; 451/6; 451/7; 451/285; 451/286; 451/287; 451/288; 428/343; 156/277

(58) Field of Search ..... 451/5, 6, 7, 41, 451/285, 286, 287, 288; 428/343; 156/277

(56) References Cited

U.S. PATENT DOCUMENTS

| | | | | |
|---|---|---|---|---|
| 5,949,927 | A | | 9/1999 | Tang |
| 6,071,177 | A | | 6/2000 | Lin et al. |
| 6,247,998 | B1 | | 6/2001 | Wiswesser et al. |
| 6,358,130 | B1 | | 3/2002 | Freeman et al. |
| 6,361,646 | B1 | | 3/2002 | Bibby, Jr. et al. |
| 6,447,369 | B1 | | 9/2002 | Moore |
| 6,524,164 | B1 | * | 2/2003 | Tolles ..... 451/6 |
| 6,544,104 | B1 | * | 4/2003 | Koike et al. ..... 451/9 |
| 6,641,471 | B1 | * | 11/2003 | Pinheiro et al. ..... 451/526 |

OTHER PUBLICATIONS

"About Pressure Sensitive Adhesives and Contact Adheseives", http://industrial–adhesives.globalspec.com/Learn-More/Materials_Chemicals/Adhesives/Pressure_Sensitive_Contact_Adhesives, printed Apr. 2, 2004.

Loctite Technical Data Sheet, Product 401, Worldwide Version, Oct. 1995.

Loctite Technical Data Sheet, Product 770, Worldwide Version, May 2000.

* cited by examiner

*Primary Examiner*—Joseph J. Hail, III
*Assistant Examiner*—Alvin J. Grant
(74) *Attorney, Agent, or Firm*—Fish & Richardson

(57) ABSTRACT

Polishing pads with a window, systems containing such polishing pads, and processes that use such polishing pads are disclosed. In embodiments, a polishing pad includes a backing layer having an opening, a polishing layer having an opening aligned with the opening in the backing layer, a solid window of a first material in the opening of the polishing layer, a layer of a first adhesive material between the backing layer and the solid window, and a layer of a second adhesive material between the layer of the first adhesive material and the window.

33 Claims, 2 Drawing Sheets

POLISHING PAD WITH WINDOW

TECHNICAL FIELD

The invention generally relates to polishing pads with a window, systems containing such polishing pads, and processes for making and using such polishing pads.

BACKGROUND

The process of fabricating modem semiconductor integrated circuits (IC) often involves forming various material layers and structures over previously formed layers and structures. However, the underlying features can leave the top surface topography of an in-process substrate highly irregular, with bumps, areas of unequal elevation, troughs, trenches, and/or other surface irregularities. These irregularities can cause problems in the photolithographic process. Consequently, it can be desirable to effect some type of planarization of the substrate.

One method for achieving semiconductor substrate planarization or topography removal is chemical mechanical polishing (CMP). A conventional chemical mechanical polishing (CMP) process involves pressing a substrate against a rotating polishing pad in the presence of a slurry, such as an abrasive slurry.

In general, it is desirable to detect when the desired surface planarity or layer thickness has been reached and/or when an underlying layer has been exposed in order to determine whether to stop polishing. Several techniques have been developed for the in situ detection of endpoints during the CMP process. For example, an optical monitoring system for in situ measuring of uniformity of a layer on a substrate during polishing of the layer has been employed. The optical monitoring system can include a light source that directs a light beam toward the substrate during polishing, a detector that measures light reflected from the substrate, and a computer that analyzes a signal from the detector and calculates whether the endpoint has been detected. In some CMP systems, the light beam is directed toward the substrate through a window in the polishing pad. A layer of slurry is typically present between the substrate and an upper surface of the window.

SUMMARY

In general, the invention relates to polishing pads with a window, systems containing such polishing pads, and processes that use such polishing pads.

In one aspect, the invention features a polishing pad that includes a polishing layer having a polishing surface, and a solid window of material in the polishing layer. The window material has a surface energy of about 40 mJ/m$^2$ or less.

In another aspect, the invention features a polishing pad that includes a polishing layer having a polishing surface, and a solid window of material in the polishing layer. The window material is a fluorinated polymer.

In a further aspect, the invention features a polishing pad that includes a polishing layer having a polishing surface, and a solid window of material in the polishing layer. The window material has an index of refraction of about 1.45 or less.

In one aspect, the invention features a polishing pad that includes a backing layer having an opening, and a polishing layer having an opening aligned with the opening in the backing layer. The polishing pad also includes a solid window of a material in the opening of the polishing layer, a layer of a first adhesive material between the backing layer and the solid window, and a layer of a second adhesive material between the backing layer and the solid window. The second adhesive material is different from the first adhesive material.

In another aspect, the invention features a polishing pad that includes a backing layer having an opening, and a polishing layer having an opening aligned with the opening in the backing layer. The polishing pad also includes a solid window of a first material in the opening of the polishing layer, and a layer of an adhesive material between the backing layer and the window. The adhesive material can be, for example, a polyolefin polymer or an acrylate polymer.

In a further aspect, the invention features a method of constructing a polishing pad. The method includes inserting first and second substantially coextensive layers of adhesive material in an opening in a polishing pad, and adhering a window of solid material to a surface of the first layer of adhesive material.

In one aspect, the invention features a method of constructing a polishing pad that includes adhering a window of a solid material to a first layer of adhesive material, the first layer of adhesive material being adhered to a layer of a second adhesive material different from the first adhesive material, thereby forming an article. The method also includes inserting the article in an opening in a polishing layer having a polishing surface.

In another aspect, the invention features a method of constructing a polishing pad that includes modifying a surface of a transparent article by a method selected from the group consisting of corona treatment, flame treatment and fluorine gas treatment, and securing the article in an opening in a polishing layer having a polishing surface.

Embodiments can include one or more of the following features.

The polishing pad can further include a backing layer supporting the polishing layer.

The window material can have a surface energy of about 30 mJ/m$^2$ or less (e.g., about 20 mJ/m$^2$ or less).

The window material can be a perfluorinated polymer (e.g., a polytetrafluoroethylene).

The window material can have an index of refraction of about 1.4 or less (e.g., an index of refraction that is about the same as water).

The window material can transmit at least about 25% of light impinging thereon at one or more wavelengths of interest (e.g., ultraviolet, infrared, from about 400 nm to about 800 nm, from about 400 nm to about 450 nm, from about 400 nm to about 410 nm, from about 650 nm to about 800 nm).

The first adhesive material can be a polymer, such as an acrylate polymer (e.g., a cyanoacrylate polymer), or a polyolefin polymer.

The first adhesive material can be a primer for acrylate polymers (e.g., a primer for cyanoacrylate polymers).

The first adhesive material can be a double coated film tape.

The polishing pad can be incorporated in an apparatus for polishing a surface of a substrate. The apparatus can further include a platen having a surface on which the polishing pad is disposed, and a polishing head configured to hold the substrate. The polishing head and the polishing pad can be configured so that during operation of the apparatus the surface of the substrate contacts the polishing surface.

In certain embodiments, the window-polishing pad construction can exhibit one or more of the following desirable characteristics: good transmission of energy at the wavlength(s) of interest, good resistance to scratching and/or abrasion during the CMP process, good resistance to fluid (e.g., slurry or water) leakage, and/or relatively low refractive index. In some embodiments, at least two (e.g., all) of these properties are exhibited despite the window being made from a material that generally has relatively low surface energy (e.g., low adhesion to many other materials). This can be particularly advantageous when the material from which the window is made has a relatively low surface energy (e.g., polytetrafluoroethylene) and when the window material has good transmission in the blue range of the visible spectrum (e.g., from about 400 nm to about 450 nm, such as from about 400 nm to about 410 nm), which is desirable when a blue laser or a blue LED is used as the light source.

Features, objects and advantages of the invention are in the description, drawings and claims.

DETAILED DESCRIPTION

Figure 1:
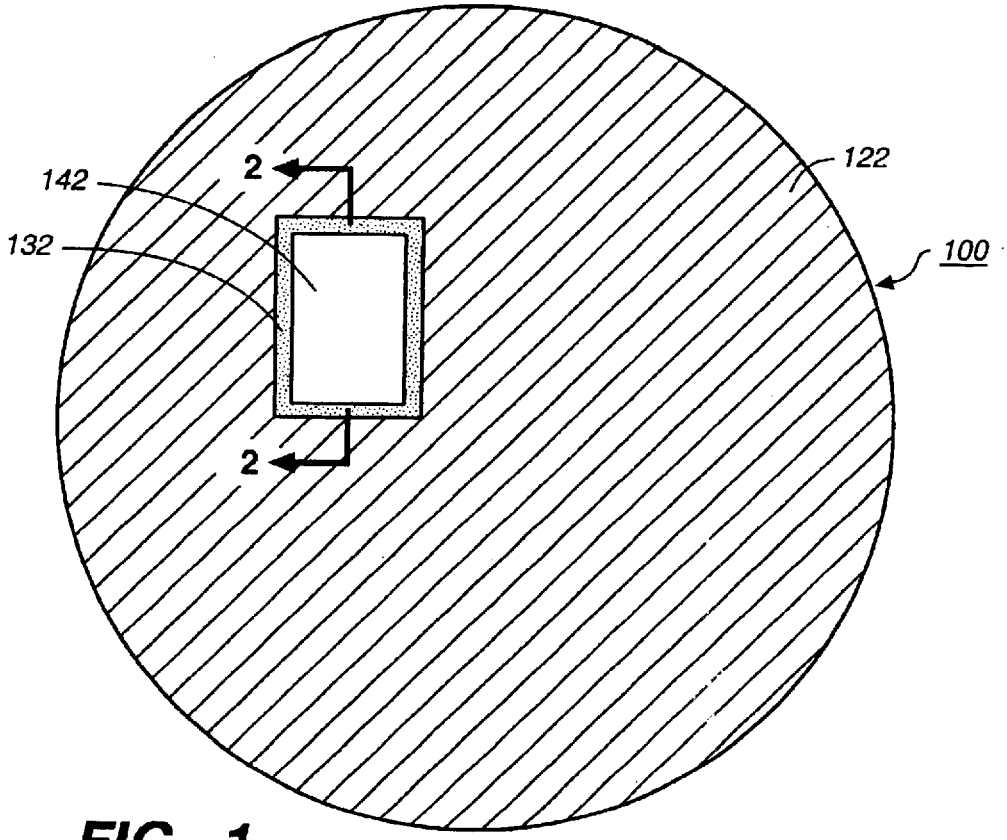
FIG. 1 is a top view of an embodiment of a polishing pad with a window.
Figure 2:
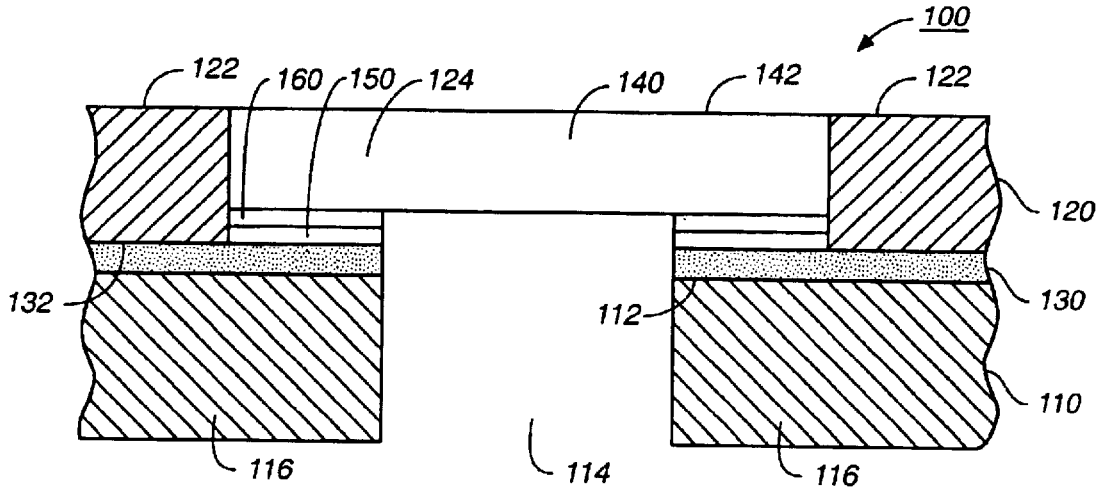
FIG. 2 is a cross-sectional view of the polishing pad of FIG. 1.

As shown in FIGS. 1 and 2, a polishing pad 100 includes a backing layer 110 having an upper surface 112 and a covering layer 120 having a polishing surface 122. An opening 114 in layer 110 is aligned with an opening 124 in layer 120 such that ledges 116 of layer 110 extend under a portion of opening 124. Backing layer 110 and covering layer 120 are held together by an adhesive layer 130 that extends along upper surface 112 of backing layer 110. A window of solid material 140 is disposed in opening 114 and is held in place by an adhesive layer 160. Layer 160 is adhered to adhesive layer 150, which, in turn, is adhered to an upper surface 132 of layer 130. Although the sidewalls of window 140 are depicted as being flush with the sidewalls of covering layer 120, in some embodiments, there is a small gap between the sidewalls of window 140 and the sidewalls of covering layer 120. In addition, although the top surface of the window 140 is depicted as flush with the polishing surface 122 of the covering layer 120, in some embodiments the top surface can be recessed below the polishing surface 122.

In general, backing layer 110, covering layer 120 and adhesive layer 130 can be formed of any appropriate materials for use in CMP processes. For example, layers 110, 120 and 130 can be formed from materials used in the corresponding layers in commercially available polishing pads, such as an IC-1000 polishing pad or IC-1010 polishing pad (from Rodel, Phoenix, Ariz.). In some embodiments, backing layer 110 is formed of a relatively compressible layer, such as a Suba-IV layer (from Rodel, Phoenix Ariz.). In certain embodiments, adhesive layer 130 is formed of a double coated film tape. Commercially available double coated film tapes are available from, for example, Minnesota Mining and Manufacturing Co., Inc. (St. Paul, Minn.) (e.g., a member of the 442 family of double coated film tapes). Adhesive tapes from which layer 130 can be formed are also commercially available from, for example, Scapa North America (Windsor, Conn.).

In certain embodiments, the material from which window 140 is made is relatively resistant to the conditions to which it is exposed during the CMP process. As an example, the material from which window 140 is made can be relatively chemically inert to the slurry and substrate material. As another example, the window can be relatively resistant to scratching and/or abrasion caused by the slurry (e.g., containing one or more chemical agents and optionally abrasive particles) used in the CMP process. As a further example, the material from which window 140 is made can be relatively resistant to scratching and/or abrasion caused by the substrate. As another example, the material from which window 140 is made can be relatively resistant to scratching and/or abrasion caused by the pad conditioner. In embodiments, window 140 can be formed of a material having a Shore D hardness of from about 40–95.

In some embodiments, the material from which window 140 is made is substantially transparent to energy in the range of wavelength(s) of interest. In certain embodiments, at least about 25% (e.g., at least about 35%, at least about 50%, at least about 60%, at least about 70%, at least about 80%, at least about 90%, at least about 95%) of energy at a wavelength of interest that impinges upon window 140 is transmitted through window 140.

In certain embodiments, the material from which window 140 is made has a relatively low refractive index. For example, the material from which window 140 is made can have a refractive index of about 1.48 or less (e.g., about 1.45 or less, about 1.4 or less, about 1.35 or less, about the same as the refractive index of water). Without wishing to be bound by theory, it is believed that using a material having a relatively low refractive index can reduce reflections from the interface at a surface 142 of window 140 (e.g., an interface of air, water (slurry) and window 140) and improve transmission of energy having the wavelength(s) of interest, which is believed to improve the signal to noise ratio of the data collected in the CMP process.

In some embodiments, window 140 can be formed of a highly optically isotropic polymer. An isotropic material can help maintain the polarization of the interrogating light beam. For example, the material from which window 140 is formed can be more isotropic than conventional polyurethanes that are used as window material. A highly optically isotropic polymer can be formed, for example, by molding under low stress conditions.

The material from which window 140 is formed can be hydrophilic or hydrophobic. A hydrophilic material can help ensure that there is a layer of slurry or water between the substrate and the window. The presence of the layer of slurry or water prevents the creation of an interface which can cause significant signal distortion. Although some polymer materials tend to be hydrophobic, they can be changed from hydrophobic to hydrophilic using surface treatments, such as roughening or etching. However, for certain applications it may be useful for window 140 to be formed of a relatively hydrophobic window. For example, if a substrate being polished has a hydrophilic layer ($SiO_2$, $Si_3N_4$, etc.) on top of hydrophobic layer (Poly Silicon, single crystal Silicon, etc.), then the tendency of the substrate to repel water will increase as the hydrophilic layer is polished away. This transition can be detectable by monitoring the intensity signal from the detector.

The surface energy of window 140 can be selected as desired. In some embodiments, window 140 is formed of a material that has relatively high surface energy, such as a surface energy of at least about 42 $mJ/m^2$ (e.g., at least about 44 $mJ/m^2$, at least about 45 $mJ/m^2$, at least about 46 $mJ/m^2$). In certain embodiments, window 140 is formed of a material that has a relatively low surface energy, such as about 40 $mJ/m^2$ or less (e.g., about 37 $mJ/m^2$ or less, about 35 $mJ/m^2$ or less, about 33 $mJ/m^2$ or less, about 31 $mJ/m^2$ or less, about 25 $mJ/m^2$ or less, about 20 $mJ/m^2$ or less, about 18 $mJ/m^2$). The surface energy of a material refers to the is measured by, for example, ASTM D5725-99.

In certain embodiments, the surface of a material can be modified (e.g., by corona treatment, flame treatment and/or fluorine gas treatment) to increase the surface energy of the material. In general, the surface energy of a material having a modified surface falls within the ranges noted above.

In general, window 140 is formed of one or more polymeric materials, such as, for example, a polyurethane or a halogenated polymer (e.g., polychlorotrifluoroethylene (PCTFE), perfluoroalkoxy (PFA), fluorinated ethylene propylene (FEP), or polytetrafluoroethylene (PTFE)). Polymeric materials from which window 140 can be formed are disclosed, for example, in U.S. Pat. No. 5,893,796, co-pending, commonly-owned U.S. Provisional Patent Application Serial No. 60/390,679, filed Jun. 21, 2002, and entitled "Polymer Material and Method of Forming a Pad Window," and co-pending, commonly-owned U.S. patent application Ser. No. 10/035,391, filed Dec. 28, 2001, and entitled "Polishing Pad With Transparent Window," the entire contents of each of which are hereby incorporated by reference. Examples of commercially available polymeric materials from which window 140 can be formed include polyurethane materials available from Rodel (Phoenix, Ariz.), Calthane ND3200 polyurethane (from Cal Polymers, Long Beach, Calif.), Conoptic DM-2070 polyurethane (Cytec Industries Inc., West Paterson, N.J.), FEP X 6301, FEP X 6303, and FEP X 6307 (all from Dyneon LLC, Oakdale, Minn.), the Neoflon® family of PCTFE polymers (from Daikin America, Inc., Orangeburg, N.J.) and the Teflon® family of PTFE polymers (from E.I. du Pont de Nemours and Company, Wilmington, Del.).

In general, adhesive layer 150 is formed of a material that has good adhesion to both layers 130 and 160. In certain embodiments, adhesive layer 150 is formed of one or more polymeric adhesives. Examples of polymeric adhesives from which layer 150 can be formed include acrylate polymers, including rubber toughened acrylate polymers and high viscosity acrylate polymers. Examples of acrylate polymers include cyanoacrylate polymers, including rubber toughened cyanoacrylate polymers and high viscosity acrylate polymers. Examples of commercially available adhesive polymers from which layer 150 can be formed include Loctite® 401 adhesive, Loctite® 406 adhesive, Loctite® 410 adhesive and Loctite® 411 adhesive (Loctite Corporation, Rocky Hill, Conn.).

In general, adhesive layer 160 is formed of a material that has good adhesion to both layer 150 and window 140. Without wishing to be bound by theory, it is believed using a material with such adhesive properties for layer 160 can reduce the probability that window 140 will become un-adhered within polishing pad 100. This can be particularly desirable, for example, when window 140 is formed of a material that has a relatively low surface energy (e.g., when window 140 is formed of certain halogenated polymers, such as a PTFE). It is also believed that using a material with such adhesive properties for layer 160 can reduce the probability that liquid (e.g., slurry or water) will leak from surface 142 of window 140 to a region under window 140, layer 160, layer 150 and/or layer 140. This can be advantageous, for example, when such leaking of a liquid would interfere with the optical measurements being made (e.g., such as by moisture formation at a region under window 140, layer 160, layer 150 and/or layer 140).

In certain embodiments, adhesive layer 160 is formed of one or more polymeric adhesives. Examples of polymeric adhesives from which layer 160 can be formed include polyolefin polymers. Examples of commercially available adhesive polymers from which layer 160 can be formed include Loctite® primer adhesives (from Loctite Corporation, Rocky Hill, Conn.), such as Loctite® 770 primer adhesive, Loctite® 7701 primer adhesive, Loctite® 793 primer adhesive, Loctite® 794 primer adhesive, and Loctite® 7951 primer adhesive. In embodiments, layer 160 is formed of a primer for layer 150 (e.g., a primer for an acrylate polymer, a primer of a cyanoacrylate polymer).

In general, polishing pad 100 can be constructed as desired. Typically, a three layer structure of backing layer 110 (with opening 114), adhesive layer 130 and covering layer 120 (with opening 124) are adhered together. In certain embodiments, layers 150 and 160 are adhered together, window 140 is adhered to layer 160, and layers 150 and 160 and window 140 are inserted into opening 124. In some embodiments, layers 150 and 160 are adhered together and placed into opening 124, and then window 140 is adhered to layer 160.

Figure 3:
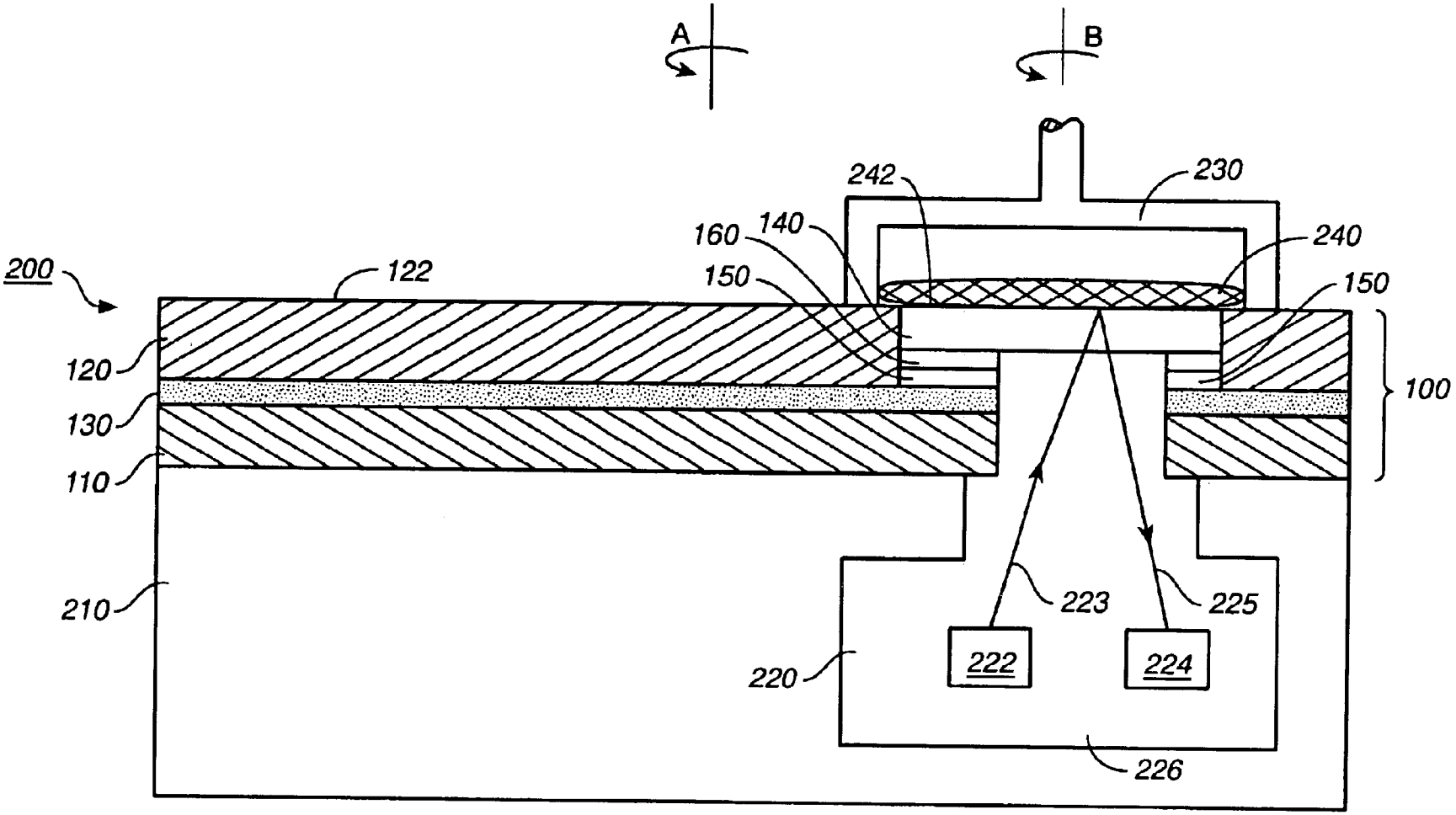
FIG. 3 is a cross-sectional view of a CMP apparatus containing the polishing pad of FIG. 1.

FIG. 3 shows a CMP apparatus 200 including polishing pad 100 disposed on a platen 210. Platen 210 contains an optical monitoring system 220 including a light source 222 (e.g., a laser, such as a red laser, a blue laser, or an infrared laser, or a light emitting diode, such as a red light emitting diode, a blue light emitting diode, or an infrared light emitting diode) and a light detector 224 (e.g., a photodetector). Optical monitoring system 220 is housed in a recess 226 in platen 210. Apparatus 200 also includes a polishing head 230 for holding a substrate 240 (e.g., a semiconductor substrate).

In general, during use of apparatus 200 in a CMP process, a chemical polishing solution (e.g., a slurry containing one or more chemical agents and optionally abrasive particles) is applied to polishing surface 122 of covering layer 120 as platen 210, polishing pad 100 and optical monitoring system 220 rotate about an axis shown by arrow A. Polishing head 230 is lowered so that a surface 242 of substrate 240 comes into contact with slurry/polishing surface 122, and polishing head 230 and substrate 240 are rotated about an axis shown by arrow B. Light source 222 directs light beam 223 at surface 242, and light detector 224 measures the light beam 225 that is reflected from substrate 242 (e.g., from surface 242 and/or the surface of one or more underlying layers in substrate 242). The wavelength(s) of light in beam 223 and/or 225 can vary depending upon the property being detected. As an example, the wavelength(s) of interest can span the visible spectrum (e.g., from about 400 nm to about 800 nm). As another example, the wavelength(s) of interest can be within a certain portion of the visible spectrum (e.g., from about 400 nm to about 450 nm, from about 650 nm to about 800 nm). As an additional example, the wavelength(s) of interest may be outside the visible portion of the spectrum (e.g., ultraviolet (such as from about 300 nm to about 400 nm), infrared (such as from about 800 nm to about 1550 nm)). The information collected by detector 224 is processed to determine whether the polishing endpoint has been reached. For example, an unillustrated computer can receive the measured light intensity from detector 224 and use it to determine the polishing endpoint (e.g., by detecting a sudden change in the reflectivity of substrate 242 that indicates the exposure of a new layer, by calculating the thickness removed from the outer layer (such as a transparent oxide layer) of substrate 242 using interferometric principles, and/or by monitoring the signal for predetermined endpoint criteria).

While certain embodiments have been described, the invention is not so limited.

As an example, a portion of opening 114 in covering layer 110 can be filled with a transparent solid piece 31, such as a quartz block (e.g., within window 140).

As another example, polishing head 230 and semiconductor substrate 240 can translate during operation of apparatus 200. In general, light source 222 and light detector 224 are positioned such that they have a view of substrate 240 during a portion of the rotation of platen 210, regardless of the translational position of head 230.

As a further example, optical monitoring system 200 can be a stationary system located below platen 210.

As an additional example, a polishing pad may contain a covering layer and no backing layer, or a polishing pad can be a fixed-abrasive pad with abrasive particles held in a containment media.

As yet another example, the polishing pad can be formed without layer 150.

As still a further example, the polishing pad can be formed without layer 160.

As another example, an additional layer of adhesive (e.g., formed of a material noted above for layer 130) can be present on the underside of backing layer 110. Typically, such an additional layer would not extend over opening 114 in layer 110.

Other embodiments are in the claims.

What is claimed is:

1. A polishing pad, comprising:

a polishing layer having a polishing surface; and a solid window of material in the polishing layer, the material having a surface energy of about 40 $mJ/m^2$ or less, wherein the surface of the material has been modified by a method selected from the group consisting of corona treatment, flame treatment and fluorine gas treatment.

2. The polishing pad of claim 1, wherein the material has a surface energy of about 30 $mJ/m^2$ or less.

3. The polishing pad of claim 1, wherein the material comprises a fluorinated polymer.

4. A polishing pad, comprising:

a backing layer having an opening;

a polishing layer having an opening aligned with the opening in the backing layer;

a solid window of a first material in the opening of the polishing layer;

a layer of a first adhesive material between the backing layer and the solid window; and a layer of a second adhesive material between the layer of the first adhesive material and the solid window, the second adhesive material being different from the first adhesive material.

5. The polishing pad of claim 4, wherein the first adhesive material comprises a polymer.

6. The polishing pad of claim 4, wherein the first adhesive material comprises a material selected from the group consisting of an acrylate polymer, a cyanoacrylate polymer, a polyolefin polymer.

7. The polishing pad of claim 6, wherein the first adhesive material comprises a polyolefin polymer that is a primer for acrylate or cyanoacrylate polymers.

8. The polishing pad of claim 4, wherein the first adhesive material comprises a double coated film tape.

9. The polishing pad of claim 4, further comprising a layer of a third adhesive material between the layer of the first adhesive material and the layer of the second adhesive material.

10. The polishing pad of claim 9, wherein the third material comprises an acrylate polymer and the second material comprises a primer for the first material.

11. The polishing pad of claim 4, further comprising a layer of a third adhesive material between the backing layer and the layer of the second adhesive material.

12. The polishing pad of claim 11, wherein the second material comprises an acrylate polymer and the first material comprises a primer for the first material.

13. The polishing pad of claim 4, wherein the first material comprises an acrylate polymer and the second material comprises a primer for the first material.

14. The polishing pad of claim 4, wherein a portion of the backing layer extends under the opening in the polishing layer, and the layer of the first adhesive material extends over the portion of the backing layer.

15. The polishing pad of claim 4, wherein the layer of the first adhesive material comprises a polyolefin polymer and the layer of the second adhesive material comprises an acrylate polymer.

16. The polishing pad of claim 4, wherein the first material comprises a fluorinated polymer.

17. A polishing pad, comprising:

a backing layer having an opening;

a polishing layer having an opening aligned with the opening in the backing layer;

a solid window of a first material in the opening of the polishing layer;

an adhesive material between the backing layer and the window, the material comprising a polyolefin polymer.

18. The polishing pad of claim 17, wherein a portion of the backing layer extends under the opening in the polishing layer, and the layer of the adhesive material extends over the portion of the backing layer.

19. The polishing pad of claim 17, wherein the first material comprises a fluorinated polymer.

20. The polishing pad of claim 17, wherein the adhesive material further comprises an acrylate polymer.

21. The polishing pad of claim 17, wherein the acrylate polymer comprises a cyanoacrylate polymer.

22. A window for a polishing pad, comprising:

a substantially transparent solid article having a surface;

a layer of a first adhesive material having first and second surfaces, the first surface of the layer of the first adhesive material being disposed against the surface of the arficle; and a layer of a second adhesive material having a surface, the second adhesive material being different from the first adhesive material, the surface of the layer of the second adhesive material being disposed against the second surface of the layer of the first adhesive material.

23. The article of claim 22, wherein the substantially transparent solid article having a surface energy of about 40 $mJ/m^2$ or less.

24. The article of claim 22, wherein the substantially transparent solid article comprises a fluorinated polymer.

25. A method of constructing a polishing pad, comprising:

inserting first and second substantially coextensive layers of adhesive material in an opening in a polishing pad, the second layer of adhesive being different from the first layer; and adhering a window of solid material to a surface of the first layer of adhesive material.

26. The method of claim 25, wherein the window of solid material has a surface energy of about 40 $mJ/m^2$ or less.

27. The method of claim 25, wherein the window of solid material comprises a fluorinated polymer.

28. The method of claim 25, wherein the window of solid material has an index of refraction of about 1.45 or less.

29. A method of constructing a polishing pad, comprising:

adhering a window of a solid material to a first layer of adhesive material, the first layer of adhesive material being adhered to a layer of a second adhesive material, thereby forming an article; and inserting the article in an opening in a polishing layer having a polishing surface.

30. The method of claim 29, wherein the window of solid material has a surface energy of about 40 $mJ/m^2$ or less.

31. The method of claim 29, wherein the window of solid material comprises a fluorinated polymer.

32. The method of claim 29, wherein the window of solid material has an index of refraction of about 1.45 or less.

33. A method of constructing a polishing pad, comprising:

modifying a surface of a transparent article by a method selected from the group consisting of corona treatment, flame treatment and fluorine gas treatment;

securing the article in an opening in a polishing layer having a polishing surface.

* * * * *

UNITED STATES PATENT AND TRADEMARK OFFICE

CERTIFICATE OF CORRECTION

PATENT NO. : 6,832,950 B2
APPLICATION NO. : 10/282730
DATED : December 21, 2004
INVENTOR(S) : Jason Wright, Andreas Norbert Wiswesser and Bogdan Swedek It is certified that error appears in the above-identified patent and that said Letters Patent is hereby corrected as shown below:

Title Page Item (56), Other Publication, change "Contact Adheseives" to --Contact Adhesives--.

Title Page Item (74), Attorney, Agent, or Firm, after "Richardson" insert --, P.C.--.

Claim 22, line 6, change "arficle" to --article--.

Claim 24, line 2, change "having" to --has--.

Signed and Sealed this

Twenty-first Day of November, 2006

JON W. DUDAS
*Director of the United States Patent and Trademark Office*